US009390677B2

(12) United States Patent
Choo et al.

(10) Patent No.: US 9,390,677 B2
(45) Date of Patent: Jul. 12, 2016

(54) LIGHT EMITTING DIODE DISPLAY DEVICE WITH IMAGE DATA DEPENDENT COMPENSATION AND METHOD FOR DRIVING THE SAME

(71) Applicant: LG Display Co., Ltd., Seoul (KR)

(72) Inventors: Kyo-Hyuck Choo, Paju-si (KR); Eui-Yeol Oh, Seoul (KR); Jung-Hoon Seo, Goyang-si (KR); Seok-Jun Kang, Suwon-si (KR)

(73) Assignee: LG DISPLAY CO., LTD., Seoul (KR)

( * ) Notice: Subject to any disclaimer, the term of this patent is extended or adjusted under 35 U.S.C. 154(b) by 528 days.

(21) Appl. No.: 13/728,816

(22) Filed: Dec. 27, 2012

(65) Prior Publication Data

US 2014/0043318 A1 Feb. 13, 2014

(30) Foreign Application Priority Data

Aug. 7, 2012 (KR) ..... 10-2012-0086453

(51) Int. Cl.
*G09G 5/00* (2006.01)
*G09G 3/32* (2016.01)

(52) U.S. Cl.
CPC ..... *G09G 5/00* (2013.01); *G09G 3/3225* (2013.01); *G09G 2320/043* (2013.01); *G09G 2320/045* (2013.01); *G09G 2320/048* (2013.01); *G09G 2340/16* (2013.01); *G09G 2360/16* (2013.01)

(58) Field of Classification Search
CPC ..... G09G 5/00; G09G 2320/043; G09G 2320/048
See application file for complete search history.

(56) References Cited

U.S. PATENT DOCUMENTS

2005/0088379 A1* 4/2005 Tsuchida ..... 345/76
2008/0174591 A1* 7/2008 Park et al. ..... 345/212
2010/0007656 A1* 1/2010 Okamoto et al. ..... 345/214

FOREIGN PATENT DOCUMENTS

CN 102131058 A 7/2011
JP 2001-343900 A 12/2001
JP 2005-128272 A 5/2005

(Continued)

OTHER PUBLICATIONS

Korean Intellectual Property Office, Office Action, Korean Patent Application No. 10-2012-0086453, Oct. 30, 2014, seven pages [with concise explanation of relevance in English].

(Continued)

*Primary Examiner* — William Boddie
*Assistant Examiner* — Andrew Schnirel
(74) *Attorney, Agent, or Firm* — Fenwick & West LLP

(57) ABSTRACT

Disclosed are a light emitting diode (LED) display device and a method for driving the same which are capable of decreasing degradation of pixels. The LED display device includes a system for outputting image data to be supplied to pixels, a compensation value generator for determining a drive time of a light emitting element in each pixel, based on the image data from the system, and generating a compensation value for the pixel, based on the determined drive time, a compensation value adjuster for determining at least one of a degree of complexity and a degree of motion in an image for each pixel, based on the image data from the system, thereby adjusting the compensation value generated, for the pixel, from the compensation value generator, and an image modulator for modulating the image data from the system, based on the adjusted compensation value from the compensation value adjuster.

32 Claims, 13 Drawing Sheets

(56) References Cited

FOREIGN PATENT DOCUMENTS

| | | | |
|---|---|---|---|
| JP | 4399087 | B2 | 10/2009 |
| JP | 2010-020078 | A | 1/2010 |
| KR | 10-2009-0060777 | A | 6/2009 |

OTHER PUBLICATIONS

State Intellectual Property Office of the People's Republic of China, First Office Action, Chinese Patent Application No. 201210599187.2, Feb. 28, 2015, nine pages.

* cited by examiner

FIG.4

| | | | | | | | | | | | |
|---|---|---|---|---|---|---|---|---|---|---|---|
| R1 | G1 | B1 | W1 | R2 | G2 | B2 | W2 | R3 | G3 | B3 | W3 |
| R4 | G4 | B4 | W4 | R5 | G5 | B5 | W5 | R6 | G6 | B6 | W6 |
| R7 | G7 | B7 | W7 | R8 | G8 | B8 | W8 | R9 | G9 | B9 | W9 |
| R10 | G10 | B10 | W10 | R11 | G11 | B11 | W11 | R12 | G12 | B12 | W12 |
| R13 | G31 | B31 | W31 | R14 | G14 | B14 | W14 | R15 | G15 | B15 | W15 |
| R16 | G16 | B16 | W16 | R17 | G17 | B17 | W17 | R18 | G18 | B18 | W18 |
| R19 | G19 | B19 | W19 | R20 | G02 | B20 | W20 | R21 | G21 | B21 | W21 |
| R22 | G22 | B22 | W22 | R23 | G23 | B23 | W23 | R24 | G24 | B24 | W24 |
| R25 | G25 | B25 | W25 | R26 | G26 | B26 | W26 | R27 | G27 | B27 | W27 |
| R28 | G28 | B28 | W28 | R29 | G29 | B29 | W29 | R30 | G30 | B30 | W30 |

FIG.9

| Motion Value \ Complexity Value | 0 | 1 | 2 | 3 | 4 | 5 | 6 | 7 | 8 | 9 | 10 |
|---|---|---|---|---|---|---|---|---|---|---|---|
| 0 | 0 | 1 | 2 | 3 | 4 | 5 | 6 | 7 | 8 | 9 | 10 |
| 1 | 1 | 2 | 3 | 4 | 5 | 6 | 7 | 8 | 9 | 10 | 11 |
| 2 | 2 | 3 | 4 | 5 | 6 | 7 | 8 | 9 | 10 | 11 | 12 |
| 3 | 3 | 4 | 5 | 6 | 7 | 8 | 9 | 10 | 11 | 12 | 13 |
| 4 | 4 | 5 | 6 | 7 | 8 | 9 | 10 | 11 | 12 | 13 | 14 |
| 5 | 5 | 6 | 7 | 8 | 9 | 10 | 11 | 12 | 13 | 14 | 15 |
| 6 | 6 | 7 | 8 | 9 | 10 | 11 | 12 | 13 | 14 | 15 | 16 |
| 7 | 7 | 8 | 9 | 10 | 11 | 12 | 13 | 14 | 15 | 16 | 17 |
| 8 | 8 | 9 | 10 | 11 | 12 | 13 | 14 | 15 | 16 | 17 | 18 |
| 9 | 9 | 10 | 11 | 12 | 13 | 14 | 15 | 16 | 17 | 18 | 19 |
| 10 | 10 | 11 | 12 | 13 | 14 | 15 | 16 | 17 | 18 | 19 | 20 |

FIG.12

| | Before Degradation Compensation | After Degradation Compensation | Remarks |
|---|---|---|---|
| Low Degree Of Complexity | ① | ③ | Degradation Level : Brightness Decrease of 12%<br>Complexity Value : 0.23<br>Compensation Level : Brightness Increase of 12% |
| High Degree Of Complexity | ② | ④ | Degradation Level : Brightness Decrease of 12%<br>Complexity Value : 4.78<br>Compensation Level : Brightness of 9% |

: Degradation Region (Brightness Decrease from Normal Value by 12%)

LIGHT EMITTING DIODE DISPLAY DEVICE WITH IMAGE DATA DEPENDENT COMPENSATION AND METHOD FOR DRIVING THE SAME

CROSS-REFERENCE TO RELATED APPLICATION

This application claims priority to Republic of Korea Patent Application No. 10-2012-0086453 filed on Aug. 7, 2012, which is incorporated by reference herein in its entirety.

BACKGROUND OF THE INVENTION

1. Field of the Invention

The present invention relates to a light emitting diode (LED) display device, and, more particularly, to an LED display device and a method for driving the same, which can reduce pixel degradation.

2. Discussion of the Related Art

Light emitting elements of a light emitting diode (LED) display device may be acceleratively degraded in accordance with an increase in drive time, thereby exhibiting reduced light emission capabilities. In order to solve such a problem, in conventional cases, image data applied to each light emitting element is accumulated for each frame period. Based on the size of the accumulated image data, the drive time of the light emitting element is calculated. A compensation value is generated, based on the calculated drive time. The compensation value is added to image data, increasing the size of original image data, to compensate the reduced light emission capability of the light emitting element.

However, the increased size of image data caused by the compensation value accelerates degradation of the light emitting element. Thus, increasing the size of image data for compensation of the drive capability of degraded pixels starts a vicious circle of accelerating pixel failure.

As a result, conventional LED display devices have a problem of accelerated degradation of pixels caused by an increase in drive time.

SUMMARY OF THE INVENTION

Accordingly, the present invention provides a light emitting diode (LED) display device and a method for driving the same, which are capable of reducing degradation of pixels by determining not only a drive time of each pixel, but also a degree of complexity and a degree of motion in image data to be supplied to the pixel, and adjusting the magnitude of a compensation value, based on the results of the determination.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a light emitting diode display device includes a system for outputting image data to be supplied to pixels each including a light emitting element, a compensation value generator for determining a drive time of the light emitting element in each of the pixels based on the image data from the system, and generating a compensation value for the pixel based on the determined drive time, a compensation value adjuster for determining at least one of a degree of complexity and a degree of motion in an image for each of the pixels based on the image data from the system, and adjusting the compensation value generated, for the pixel, from the compensation value generator based on a result of the determination, and an image modulator for modulating the image data from the system based on the adjusted compensation value from the compensation value adjuster.

The compensation value adjuster may adjust the compensation value of each of the pixels such that a difference between an original value of the compensation value and an adjusted value of the compensation value is still further increased when the image for the pixel has a still higher degree of complexity.

The compensation value adjuster may adjust the compensation value such that the adjusted compensation value is less than the original compensation value.

The compensation value adjuster may compare image data to be supplied to one of the pixels, which is a pixel in question, with n data pieces (n: a natural number greater than "1") of peripheral image data to be supplied to a plurality of peripheral pixels arranged spatially adjacent to the pixel in question, and determine a degree of complexity of the image data to be supplied to the pixel in question, based on a result of the comparison.

The compensation value adjuster may receive the image data from the system, calculate a difference between the image data piece in question and each of the n peripheral image data pieces, to derive n difference values, produce respective absolute values of the n difference values, sum the n absolute values, to derive a sum of the absolute difference values, divide the sum by "n", to derive an average value, multiply the average value by "$100/2^m-1$" (m: the number of bits of the image data piece in question or one of the peripheral image data pieces), and define a final value derived by the multiplication as a complexity value representing a degree of complexity of the image data piece for the pixel in question. The compensation value adjuster may adjust the compensation value of the pixel in question such that a difference between an original value of the compensation value and an adjusted value of the compensation value is still further increased when the final value is still higher.

The compensation value adjuster may include a complexity determiner for generating a complexity value as to each of the pixels, based on the image data from the system, and an adjuster for adjusting the compensation value supplied, for the pixel, from the compensation value generator, based on the complexity value from the complexity determiner.

The compensation value adjuster may adjust the compensation value of each of the pixels such that a difference between an original value of the compensation value and an adjusted value of the compensation value is still further increased when the image for the pixel has a still higher degree of motion.

The compensation value adjuster may adjust the compensation value such that the adjusted compensation value is less than the original compensation value.

The compensation value adjuster may compare image data to be supplied in a current frame period to one of the pixels, which is a pixel in question, with image data supplied to the pixel in question in at least one of previous frame periods, and determine a degree of motion of the image data to be supplied to the pixel in question, based on a result of the comparison.

The compensation value adjuster may receive, from the system, image data to be supplied to the pixel in question in a p-th frame period (where p is a natural number greater than "1"), and output previous image data of a "p−1"-th frame period, which has been previously stored, in response to the received image data. The compensation value adjuster may calculate a difference between the image data to be supplied to the pixel in question in the p-th frame period and the image data supplied to the pixel in question in the "p−1"-th frame period, to derive a difference value, produce an absolute value of the difference value, and define the absolute value as a motion value representing a degree of motion of the image data for the pixel in question. When the motion value for the pixel in question is greater than a predetermined motion threshold value, the compensation value adjuster may adjust the compensation value of the pixel in question such that a difference between an original value of the compensation value and an adjusted value of the compensation value is still further increased in accordance with a still further increase in a difference between the motion value and the predetermined motion threshold value. When the motion value for the pixel in question is equal to or less than the predetermined motion threshold value, the compensation value adjuster may maintain the compensation value of the pixel in question without adjustment.

The compensation value adjuster may include a frame delay for storing the image data of the p-th frame period in response to the image data supplied from the system in the p-th frame period, and simultaneously outputting previous image data of the "p−1"-th frame period, which has been previously stored, a motion determiner for generating a motion value as to each of the pixels, based on the image data from the system and the image data output from the frame delay, and an adjuster for adjusting a compensation value supplied, for the pixel, from the compensation value generator, based on the motion value from the motion determiner.

The compensation value adjuster may adjust the compensation value of each of the pixels such that a difference between an original value of the compensation value and an adjusted value of the compensation value is still further increased when the image for the pixel has a still higher degree of complexity and a still higher degree of motion.

The compensation value adjuster may adjust the compensation value such that the adjusted compensation value is less than the original compensation value.

The compensation value adjuster may compare image data to be supplied to one of the pixels, which is a pixel in question, with n data pieces (where n is a natural number greater than "1") of peripheral image data to be supplied to a plurality of peripheral pixels arranged spatially adjacent to the pixel in question, thereby determining a degree of complexity of the image data to be supplied to the pixel in question. The compensation value adjuster may compare image data to be supplied in a current frame period to the pixel in question with image data supplied to the pixel in question in at least one of previous frame periods, thereby determining a degree of motion of the image data to be supplied to the pixel in question.

The compensation value adjuster may receive the image data from the system, calculate a difference between the image data piece in question and each of the n peripheral image data pieces, to derive n difference values, produce respective absolute values of the n difference values, sum the n absolute values, to derive a sum of the absolute difference values, divide the sum by "n", to derive an average value, multiply the average value by "$100/2^m-1$" (where m is the number of bits of the image data piece in question or one of the peripheral image data pieces), and define a final value derived by the multiplication as a complexity value representing a degree of complexity of the image data piece for the pixel in question. The compensation value adjuster may receive, from the system, image data to be supplied to the pixel in question in a p-th frame period (where p is a natural number greater than "1"), and output previous image data of a "p−1"-th frame period, which has been previously stored, in response to the received image data. The compensation value adjuster may calculate a difference between the image data to be supplied to the pixel in question in the p-th frame period and the image data supplied to the pixel in question in the "p−1"-th frame period, to derive a difference value, produce an absolute value of the difference value, and define the absolute value as a motion value representing a degree of motion of the image data for the pixel in question The compensation value adjuster may adjust the compensation value of the pixel in question such that a difference between an original value of the compensation value and an adjusted value of the compensation value is still further increased when the complexity value and the motion value are still higher. When the motion value for the pixel in question is greater than a predetermined motion threshold value, the compensation value adjuster may adjust the compensation value of the pixel in question such that the difference between the original compensation value and the adjusted compensation value is still further increased in accordance with a still further increase in the complexity value and the motion value.

The compensation value adjuster may include a complexity determiner for generating a complexity value as to each of the pixels based on the image data from the system, a frame delay for storing the image data of the p-th frame period in response to the image data supplied from the system in the p-th frame period, and simultaneously outputting previous image data of the "p−1"-th frame period, which has been previously stored, a motion determiner for generating a motion value as to each of the pixels based on the image data from the system and the image data output from the frame delay, and an adjuster for adjusting the compensation value supplied, for the pixel, from the compensation value generator, based on the complexity value from the complexity determiner and the motion value from the motion determiner.

The compensation value generator may include an accumulation memory for storing image data of a plurality of previous frames in a state in which corresponding data pieces of the image data are accumulatively summed, a summer for receiving image data of a current frame from the system, summing data pieces of the image data of the current frame with data pieces of the accumulated image data stored for one frame in the accumulation memory in such a manner that corresponding ones of the data pieces are summed, to newly generate accumulated image data of one frame, and updating the accumulated one-frame image data stored in the accumulation memory with the newly-generated one-frame accumulated image data, a lookup table containing a plurality of compensation values predetermined in accordance with values of accumulated image data, and a selector for selecting, from the lookup table, compensation values corresponding to respective data pieces of one-frame accumulated image data stored in the accumulation memory.

The light emitting diode display device may further include a filter for filtering modulated image data output from the image modulator, to secure spatial and temporal uniformity of the modulated image data.

In another aspect of the present invention, a method for driving a light emitting diode display device includes the steps of (A) outputting image data to be supplied to pixels each including a light emitting element, (B) determining a drive time of the light emitting element in each of the pixels based on the image data from the step (A), and generating a compensation value for the pixel based on the determined drive time, (C) determining at least one of a degree of complexity and a degree of motion in an image for each of the pixels based on the image data from the step (A), and adjusting the compensation value generated, for the pixel, from the step (B), based on a result of the determination, and (D) modulating the image data from the step (A) based on the adjusted compensation value from the step (C).

The step (C) may adjust the compensation value of each of the pixels such that a difference between an original value of the compensation value and an adjusted value of the compensation value is still further increased when the image for the pixel has a still higher degree of complexity.

The step (C) may adjust the compensation value such that the adjusted compensation value is less than the original compensation value.

The step (C) may compare image data to be supplied to one of the pixels, which is a pixel in question, with n data pieces (where n is a natural number greater than "1") of peripheral image data to be supplied to a plurality of peripheral pixels arranged spatially adjacent to the pixel in question, and determine a degree of complexity of the image data to be supplied to the pixel in question based on a result of the comparison.

The step (C) may receive the image data from the step (A), calculate a difference between the image data piece in question and each of the n peripheral image data pieces, to derive n difference values, produce respective absolute values of the n difference values, sum the n absolute values, to derive a sum of the absolute difference values, divide the sum by "n", to derive an average value, multiply the average value by "$100/2^m-1$" (where m is the number of bits of the image data piece in question or one of the peripheral image data pieces), and define a final value derived by the multiplication as a complexity value representing a degree of complexity of the image data piece for the pixel in question. The step (C) may adjust the compensation value of the pixel in question such that a difference between an original value of the compensation value and an adjusted value of the compensation value is still further increased when the final value is still higher.

The step (C) may adjust the compensation value of each of the pixels such that a difference between an original value of the compensation value and an adjusted value of the compensation value is still further increased when the image for the pixel has a still higher degree of motion.

The step (C) may adjust the compensation value such that the adjusted compensation value is less than the original compensation value.

The step (C) may compare image data to be supplied in a current frame period to one of the pixels, which is a pixel in question, with image data supplied to the pixel in question in at least one of previous frame periods, and determine a degree of motion of the image data to be supplied to the pixel in question, based on a result of the comparison.

The step (C) may receive, from the step (A), image data to be supplied to the pixel in question in a p-th frame period (where p is a natural number greater than "1"), and output previous image data of a "p−1"-th frame period, which has been previously stored, in response to the received image data. The step (C) may calculate a difference between the image data to be supplied to the pixel in question in the p-th frame period and the image data supplied to the pixel in question in the "p−1"-th frame period, to derive a difference value, produce an absolute value of the difference value, and defines the absolute value as a motion value representing a degree of motion of the image data for the pixel in question. When the motion value for the pixel in question is greater than a predetermined motion threshold value, the step (C) may adjust the compensation value of the pixel in question such that a difference between an original value of the compensation value and an adjusted value of the compensation value is still further increased in accordance with a still further increase in a difference between the motion value and the predetermined motion threshold value. When the motion value for the pixel in question is equal to or less than the predetermined motion threshold value, the step (C) may maintain the compensation value of the pixel in question without adjustment.

The step (C) may adjust the compensation value of each of the pixels such that a difference between an original value of the compensation value and an adjusted value of the compensation value is still further increased when the image for the pixel has a still higher degree of complexity and a still higher degree of motion.

The step (C) may adjust the compensation value such that the adjusted compensation value is less than the original compensation value.

The step (C) may compare image data to be supplied to one of the pixels, which is a pixel in question, with n data pieces (where n is a natural number greater than "1") of peripheral image data to be supplied to a plurality of peripheral pixels arranged spatially adjacent to the pixel in question, thereby determining a degree of complexity of the image data to be supplied to the pixel in question. The step (C) may compare image data to be supplied in a current frame period to the pixel in question with image data supplied to the pixel in question in at least one of previous frame periods, thereby determining a degree of motion of the image data to be supplied to the pixel in question.

The step (C) may receive the image data from the step (A), calculate a difference between the image data piece in question and each of the n peripheral image data pieces, to derive n difference values, produce respective absolute values of the n difference values, sum the n absolute values, to derive a sum of the absolute difference values, divide the sum by "n", to derive an average value, multiply the average value by "$100/2^m-1$" (where m is the number of bits of the image data piece in question or one of the peripheral image data pieces), and define a final value derived by the multiplication as a complexity value representing a degree of complexity of the image data piece for the pixel in question. The step (C) may receive, from the step (A), image data to be supplied to the pixel in question in a p-th frame period (where p a natural number greater than "1"), and output previous image data of a "p−1"-th frame period, which has been previously stored, in response to the received image data. The step (C) may calculate a difference between the image data to be supplied to the pixel in question in the p-th frame period and the image data supplied to the pixel in question in the "p−1"-th frame period, to derive a difference value, produce an absolute value of the difference value, and define the absolute value as a motion value representing a degree of motion of the image data for the pixel in question. The step (C) may adjust the compensation value of the pixel in question such that a difference between an original value of the compensation value and an adjusted value of the compensation value is still further increased when the complexity value and the motion value are still higher. When the motion value for the pixel in question is greater than a predetermined motion threshold value, the step (C) may adjust the compensation value of the pixel in question such that the difference between the original compensation value and the adjusted compensation value is still further increased in accordance with a still further increase in the complexity value and the motion value.

The method may further include the step of (E) filtering modulated image data output from the step (D), to secure spatial and temporal uniformity of the modulated image data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention.

FIG. 4 is a diagram illustrating pixels included in the display device of FIG. 1.

FIG. 9 is a table illustrating gain values stored in the adjuster of FIG. 8.

FIG. 12 is a table explaining effects of the present invention.

DETAILED DESCRIPTION OF THE INVENTION

Reference will now be made in detail to the preferred embodiments of the present invention, examples of which are illustrated in the accompanying drawings.

Figure 1:
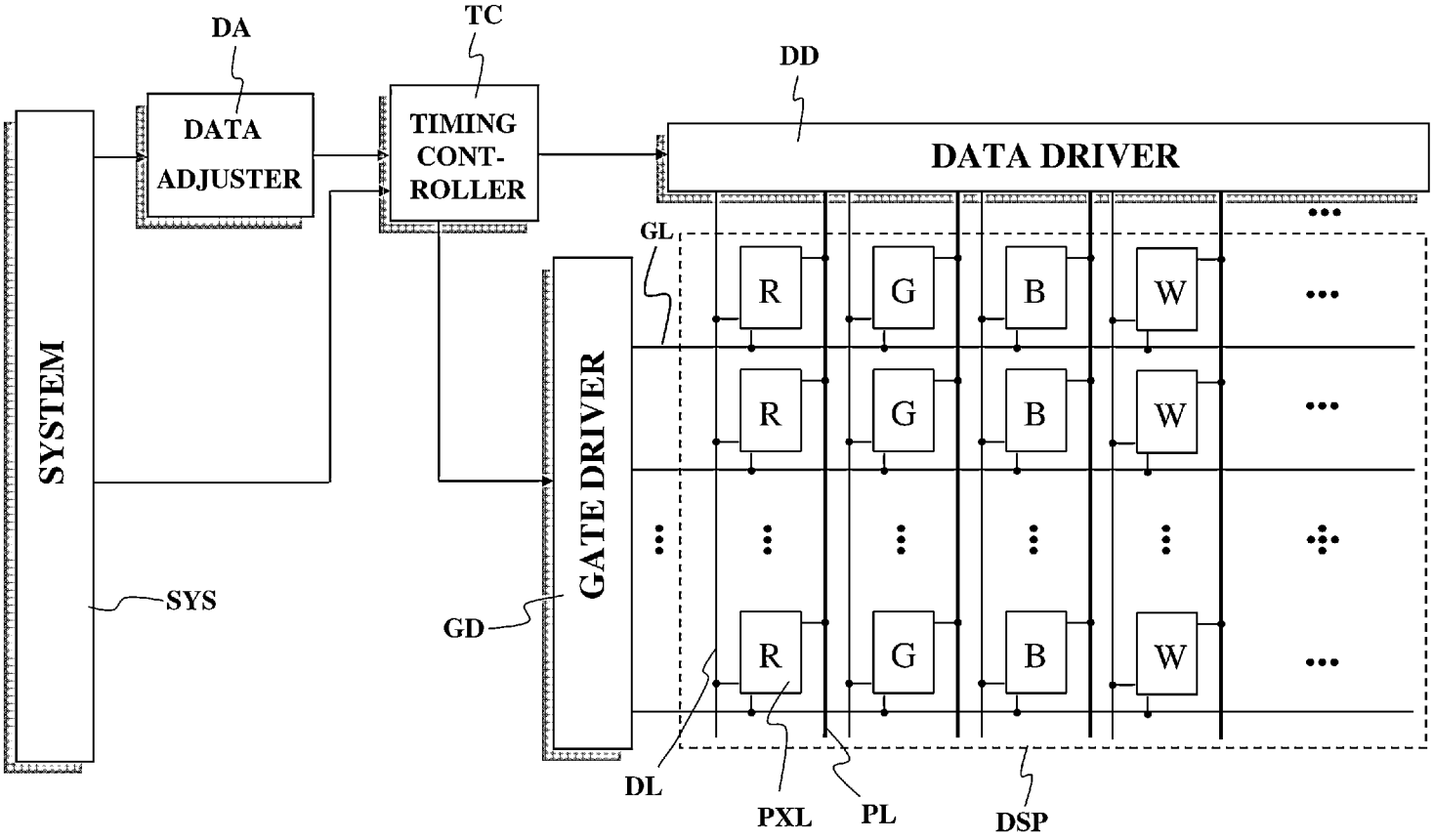
FIG. 1 is a block diagram illustrating a light emitting diode (LED) display device according to an exemplary embodiment of the present invention.
Figure 2:
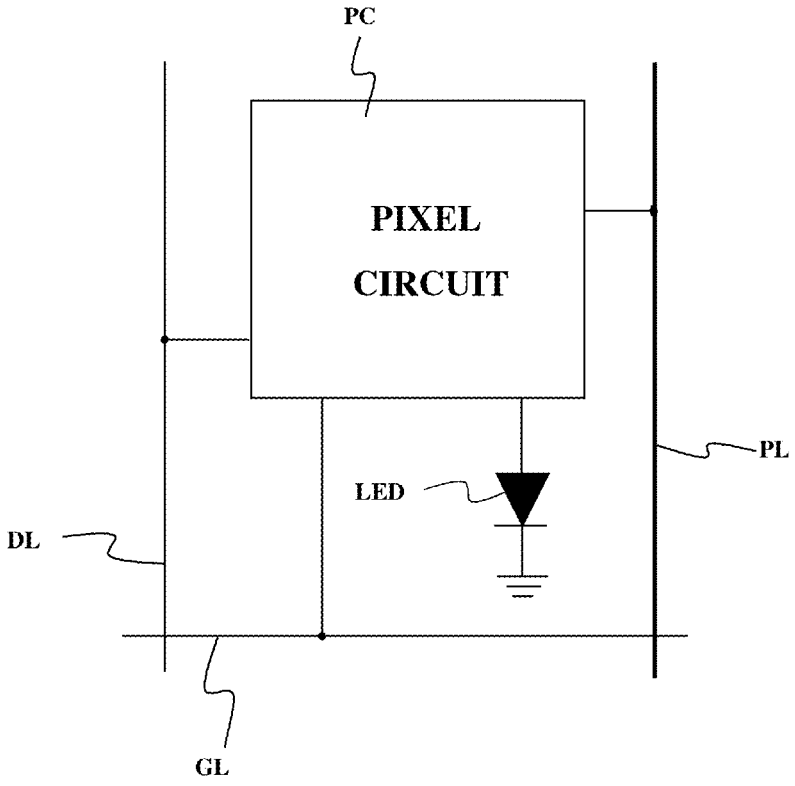
FIG. 2 is a circuit diagram illustrating one pixel of the display device shown in FIG. 1.

FIG. 1 is a block diagram illustrating a light emitting diode (LED) display device according to an exemplary embodiment of the present invention. FIG. 2 is a circuit diagram illustrating one pixel of the display device shown in FIG. 1.

As shown in FIG. 1, the LED display device according to the illustrated embodiment of the present invention includes a display DSP, a system SYS, a gate driver GD, a data driver DD, a timing controller TC, and a data adjuster DA.

The display DSP includes a plurality of pixels PXL, and various lines for transmitting various signals required to display an image, that is, a plurality of gate lines GL, a plurality of data lines DL, and a plurality of power supply lines PL. The pixels PXL are arranged on the display DSP in the form of a matrix. The pixels PXL are divided into red pixels PXL for displaying red, green pixels PXL for displaying green, blue pixels PXL for displaying blue, and white pixels W for displaying white.

As shown in FIG. 2, each pixel PXL includes a light emitting element LED, and a pixel circuit PC for generating a drive current to enable the light emitting element LED to emit light. The pixel circuit PC operates in response to a scan pulse from the corresponding gate line GL, to generate the drive current. The pixel circuit PC generates the drive current using an analog pixel voltage from the corresponding data line DL and a drive voltage from the corresponding power supply line PL. The pixel circuit PC supplies the generated drive current to the light emitting element LED which, in turn, emits light. As the light emitting element LED, an organic light emitting diode (OLED) may be employed.

The system SYS outputs a vertical synchronization signal, a horizontal synchronization signal, a clock signal, and image data transmitted from a low voltage differential signaling (LVDS) transmitter included in a graphic controller via an interface circuit. The vertical and horizontal synchronization signals and clock signal output from the system SYS are supplied to the timing controller TC. On the other hand, the image data output from the system SYS is supplied to the timing controller TC after being adjusted through the data adjuster DA.

The timing controller TC generates a data control signal and a gate control signal using the horizontal synchronization signal, vertical synchronization signal, and clock signal input thereto, and then supplies the generated data control signal and gate control signal to the data driver DD and gate driver GD, respectively. The data control signal includes a dot clock, a source shift clock, a source enable signal, a polarity inversion signal, etc. On the other hand, the gate control signal includes a gate start pulse, a gate shift clock, a gate output enable signal, etc.

The data driver DD samples image data in accordance with the data control signal from the timing controller TC, latches the sampled image data for one horizontal line in every horizontal time 1H, 2H, . . . , and then supplies the latched data to the data lines DL.

In one embodiment, the data driver DD converts the image data supplied from the timing controller TC into an analog pixel signal, using a gamma voltage input from a voltage generator, and supplies the analog pixel signal to the data lines DL.

The gate driver GD includes a shift register for generating a scan pulse in a sequential manner in response to the gate start pulse from the timing controller TC, and a level shifter for shifting the scan pulse to a voltage level suitable for driving of the pixel circuits PC of the pixels PXL. The gate driver GD sequentially supplies the scan pulse to the gate lines GL in response to the gate control signal.

The data adjuster DA modifies image data supplied from the system SYS in accordance with the accumulated size of image data supplied to each light emitting element LED and the characteristics of the image data.

First Embodiment

Figure 3:
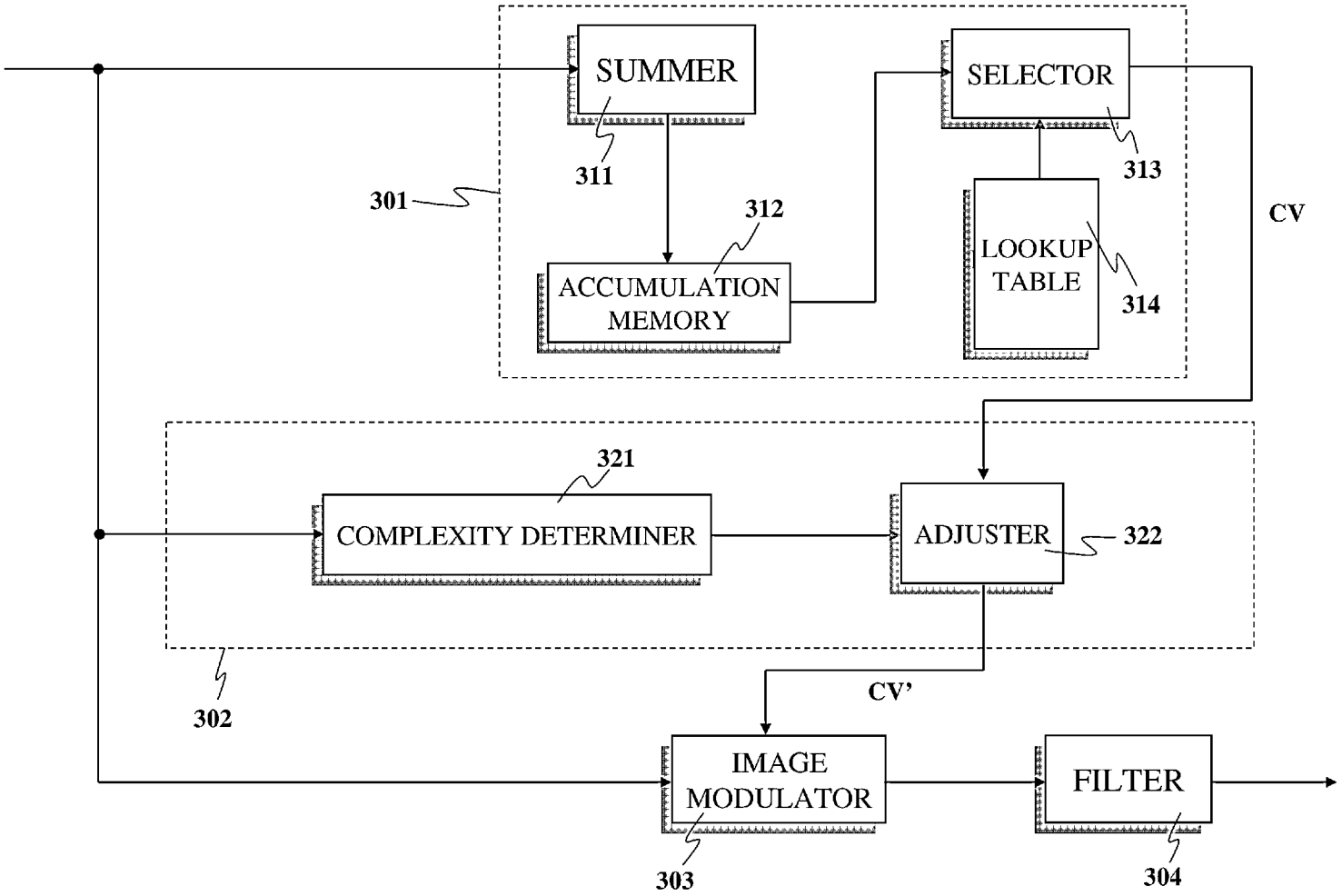
FIG. 3 is a block diagram illustrating a data adjuster according to a first embodiment of the present invention.

FIG. 3 is a block diagram illustrating a detailed configuration of the data adjuster DA according to a first embodiment of the present invention.

As shown in FIG. 3, the data adjuster DA according to the first embodiment of the present invention includes a compensation value generator 301, a compensation value adjuster 302, an image modulator 303, and a filter 304.

The compensation value generator 301 determines a drive time of the light emitting element of each pixel based on image data from the system SYS. Based on the determined drive time, the compensation value generator 301 generates a compensation value CV for the pixel. The pixel may be a red pixel R, green pixel G, blue pixel B and white pixel W.

The compensation value adjuster 302 determines a degree of complexity of an image for each pixel based on the image data from the system SYS. Based on the result of the determination, the compensation value adjuster 302 adjusts the compensation value CV output from the compensation value generator 301 for the pixel to generate an adjusted compensation value CV'. That is, the compensation value adjuster 302 varies the compensation value CV for each pixel such that the difference between the original compensation value CV and the adjusted compensation value CV' is still further increased when the image for the pixel exhibits a still higher degree of complexity. For example, the compensation value adjuster 302 may adjust an initially-set compensation value CV such that the adjusted value CV' is less than the original value.

Generally, when an image displayed on a pixel is simpler, the viewer can more easily visually perceive variation of the image. However, when an image displayed on a pixel is more complex, it is more difficult for the viewer to visually perceive variation of the image. Based on such visual perception characteristics of humans, modulation of image data is carried out in the present invention. In detail, the LED display device according to the first embodiment of the present invention applies a smaller compensation value to a pixel displaying a more complex image, which cannot be easily visually perceived and, as such, it is possible to minimize degradation of the pixel without degradation in picture quality, as compared to conventional cases.

The image modulator 303 receives the adjusted compensation value CV' from the compensation value adjuster 302 and image data from the system SYS. Based on the adjusted compensation value CV', the image modulator 303 modulates the image data.

The filter 304 filters the modulated image data output from the image modulator 303, to secure spatial and temporal uniformity of the modulated image data. For example, a low pass filter may be employed as the filter 304.

Hereinafter, configurations of the compensation value generator 301 and compensation value adjuster 302 shown in FIG. 3 will be described in more detail.

As shown in FIG. 3, the compensation value generator 301 includes an accumulation memory 312, a summer 311, a selector 313, and a lookup table 314.

Image data of a plurality of previous frames is stored in the accumulation memory 312 in state in which corresponding data pieces of the image data are accumulatively summed.

The summer 311 receives image data of the current frame from the system SYS, and then sums data pieces of the image data of the current frame with data pieces of the accumulated image data stored for one frame in the accumulation memory 312 in such a manner that corresponding ones of the data pieces are summed, to generate new accumulated image data of one frame. Thereafter, the accumulated one-frame image data stored in the accumulation memory 312 is updated with the newly-generated one-frame accumulated image data. Thus, the accumulated image data in the accumulation memory 312 is always updated with new accumulated image data every frame.

In one embodiment, the summer 311 sequentially stores data pieces of image data successively supplied from the system SYS in corresponding cells of the accumulation memory 312, respectively. In this case, the summer 311 accumulatively sums data pieces of image data of successive frames to be sequentially supplied to each pixel at intervals of x frames (where x is a natural number), and stores the summed image data in the cell corresponding to the pixel. For example, it is assumed that the total number of pixels is y (where y is a natural number), and y data pieces of image data are supplied to the y pixels in one frame period, respectively. In the current frame period, the summer 311 sequentially stores y data pieces of image data corresponding to the current frame period in first to y-th cells of the accumulation memory 312. In this case, the summer 311 accumulatively sums the y data pieces of image data in the current frame period and y data pieces of image data already stored in the first to y-th cells in the previous frame period in such a manner that corresponding data pieces of the current frame period and previous frame period are accumulatively summed. The corresponding data pieces mean image data to be sequentially supplied to the same pixel by frames. For example, the summer 311 sums the image data stored in the first cell in the previous frame period with the image data of the current frame corresponding to the first cell, and stores the summed value in the first cell. Then, the value of the first cell is updated with the summed value. In this manner, the summer 311 updates the value stored in each cell of the accumulation memory 312 with a value obtained by summing the image data in the previous frame period and the image data of the current frame (accumulated image data). Meanwhile, the value stored in each of the accumulation memory 312 may be initially set to "0" or a value other than "0".

A plurality of compensation values CV predetermined in accordance with values of accumulated image data is contained in the lookup table 314. For a higher accumulated image data value, the compensation value CV corresponding to the accumulated image data value is also higher. The values of accumulated image data and the compensation values CV, which are stored in the lookup table 314, may have a 1:1 relation. Alternatively, the compensation values CV may have an f:1 relation (where f is a natural number greater than "1"). For example, a compensation value of "1" may be applied to 6 successive accumulated image data values, which are "100", "101", "102", "103", "104, and "105", whereas a compensation value of "2" may be applied to another 6 successive accumulated image data values, which are "106", "107", "108", "109", "110, and "111".

The selector 313 selects, from the lookup table 314, compensation values CV corresponding to respective data pieces of one-frame accumulated image data stored in the accumulation memory 312. For example, the selector 313 selects, from the lookup table 314, y compensation values CV respectively corresponding to y data pieces of accumulated image data respectively stored in the y cells, as described above. Thus, the selector 313 selects and stores y compensation values CV respectively corresponding to y data pieces of image data in every frame period.

The compensation value adjuster 302 determines similarity of each pixel to pixels arranged therearound, to determine a complexity of the pixel. That is, when the pixel in question displays an image identical or similar to those of peripheral pixels, the compensation value adjuster 302 determines that the image displayed on the pixel is simple. On the other hand, when the pixel in question displays an image different from those of the surrounding pixels, the compensation value adjuster 302 determines that the image displayed on the pixel is complex.

For this determination, the compensation value adjuster 302 compares an image data piece to be supplied to the pixel in question with n peripheral image data pieces (where n is a natural value greater than "1") to be supplied to a plurality of peripheral pixels arranged spatially adjacent to the pixel in question. Based on the result of the comparison, the compensation value adjuster 302 determines a complexity of the image data to be supplied to the pixel in question.

In one embodiment, the compensation value adjuster 302 receives image data from the system SYS, and calculates a difference between the image data piece in question and each of the n peripheral image data pieces, to derive n difference values. Thereafter, the compensation value adjuster 302 produces respective absolute values of the n difference values, and sums the n absolute values, to derive a sum of the absolute difference values. The compensation value adjuster 302 subsequently divides the sum by "n", to derive an average value, and multiplies the average value by "$100/2^m-1$" (where m is the number of bits of the image data piece in question or one of the peripheral image data pieces). Finally, the compensation value adjuster 302 defines a value derived by such multiplication as a complexity value representing a degree of complexity of image data for the pixel in question. The definition may be expressed by the following Equation:

$$SV_{i,j} = (1/m) \sum_{a=i-1,b=j-1}^{i+1,j+1} |P_{i,j} - P_{a,b}| \times (100/2^m - 1)) \quad \text{[Equation 1]}$$

In Equation 1, "$SV_{i,j}$" represents a complexity value of a pixel arranged on an i-th row and a j-th column in the display (namely, a pixel in question). Hereinafter, the complexity of a specific pixel (namely, a pixel in question) will be described, assuming that "n" is 8.

Figure 5:
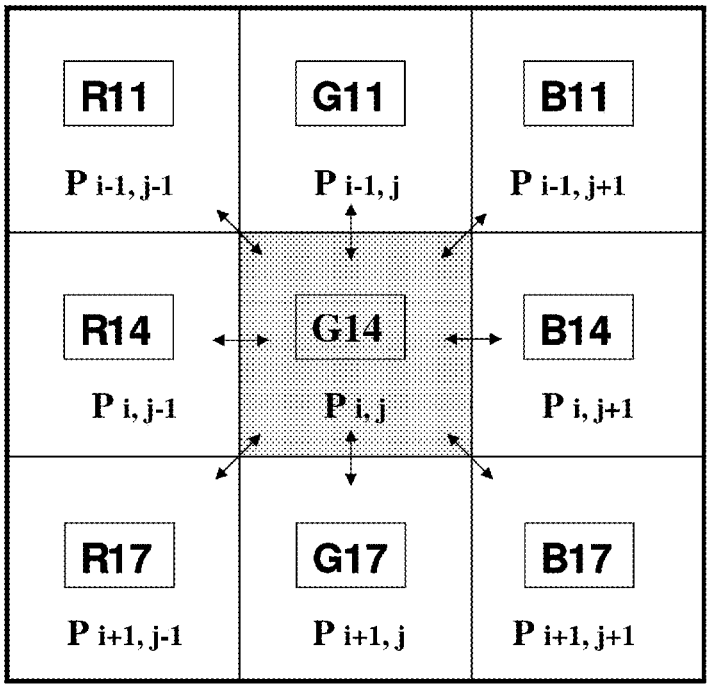
FIG. 5 is an enlarged diagram of a pixel in question and peripheral pixels shown in FIG. 4.

FIGS. 4 and 5 are diagrams explaining a method for calculating a complexity value of a pixel in question. FIG. 4 shows the pixels included in the display of FIG. 1 in the form of blocks. FIG. 5 is an enlarged diagram of the pixel in question and peripheral pixels shown in FIG. 4.

Assuming that 120 (12*10) pixels R1 to R30, G1 to G30, B1 to B30, and W1 to W30 are arranged in one display in the form of a matrix, as shown in FIG. 4, and the 14-th green pixel G14 is the pixel in question, calculation of the complexity value of the pixel in question will be described.

In order to calculate the complexity value of the 14-th green pixel G14, it is also necessary to identify image data of 8 peripheral pixels (n=8) arranged directly adjacent to the left upper, upper, right upper, left, right, left lower, lower, and right lower sides of the 14-th green pixel G14, as shown in FIG. 5. The peripheral pixels are the 11-th red pixel R11, 11-th green pixel G11, 11-th blue pixel B11, 14-th red pixel R14, 14-th blue pixel B14, 17-th red pixel R17, 17-th green pixel G17, and 17-th blue pixel B17. As used herein, "(Pi,j)" represents image data to be supplied to the pixel in question, namely, the 14-th green pixel G14, and "(Pi−1,j−1)", "(Pi−1,j)", "(Pi−1,j+1)", "(Pi,j−1)", "(Pi,j+1)", "(Pi+1,j−1)", "(Pi+1,j)", and "(Pi+1,j+1)" represent data pieces of image data to be supplied to the peripheral pixels, namely, the 11-th red pixel R11, 11-th green pixel G11, 11-th blue pixel B11, 14-th red pixel R14, 14-th blue pixel B14, 17-th red pixel R17, 17-th green pixel G17, and 17-th blue pixel B17, respectively.

Using Equation 1, the compensation value adjuster 302 calculates a difference value between the image data (Pi,j) in question and the first peripheral image data (Pi−1,j−1), namely, a first difference value. In a similar manner, the compensation value adjuster 302 calculates a difference value between the image data (Pi,j) in question and the second peripheral image data (Pi−1,j), namely, a second difference value, a difference value between the image data (Pi,j) in question and the third peripheral image data (Pi−1,j+1), namely, a third difference value, a difference value between the image data (Pi,j) in question and the fourth peripheral image data (Pi,j−1), namely, a fourth difference value, a difference value between the image data (Pi,j) in question and the fifth peripheral image data (Pi,j+1), namely, a fifth difference value, a difference value between the image data (Pi,j) in question and the sixth peripheral image data (Pi+1,j−1), namely, a sixth difference value, a difference value between the image data (Pi,j) in question and the seventh peripheral image data (Pi+1,j), namely, a seventh difference value, and a difference value between the image data (Pi,j) in question and the eighth peripheral image data (Pi+1,j+1), namely, an eighth difference value.

Thereafter, the compensation value adjuster 302 produces respective absolute values of the first to eighth difference values, and sums the 8 absolute values, to derive a sum of the absolute difference values. The compensation value adjuster 302 subsequently divides the sum by "8", to derive an average value, and multiplies the average value by "$100/2^m-1$", to derive a complexity value for the 14-th green pixel G14. When the image data has 8 bits, the value of "$2^m-1$" is 255.

In this case, the compensation value adjuster 302 adjusts the compensation value of the pixel in question such that the difference between the original compensation value and the adjusted compensation value is still further increased when the pixel in question exhibits a still higher complexity value. For example, the compensation value adjuster 302 may perform adjustment of the compensation value, using a value less than the original compensation value. In this case, when the pixel in question exhibits a still higher complexity value, the compensation value adjuster 302 adjusts the compensation value such that the adjusted compensation value is still further less than the original compensation value.

Meanwhile, the compensation value adjuster 302 may vary the adjustment magnitude for the compensation value in accordance with the color of image data. For example, even when red image data to be supplied to a red pixel, green image data to be supplied to a green pixel, blue image data to be supplied to a blue pixel, and white image data to be supplied to a white pixel exhibit the same complexity value, the adjusted compensation values for the red pixel, green pixel, blue pixel, and white pixel may be set to different values, respectively.

The compensation value adjuster 302 may include a complexity determiner 321 and an adjuster 322, as shown in FIG. 3.

The complexity determiner 321 generates a complexity value for each pixel based on image data from the system SYS.

The adjuster 322 adjusts a compensation value CV supplied from the compensation value generator 301 based on the complexity value from the complexity determiner 321, thereby generating an adjusted compensation value CV'.

Second Embodiment

Figure 6:
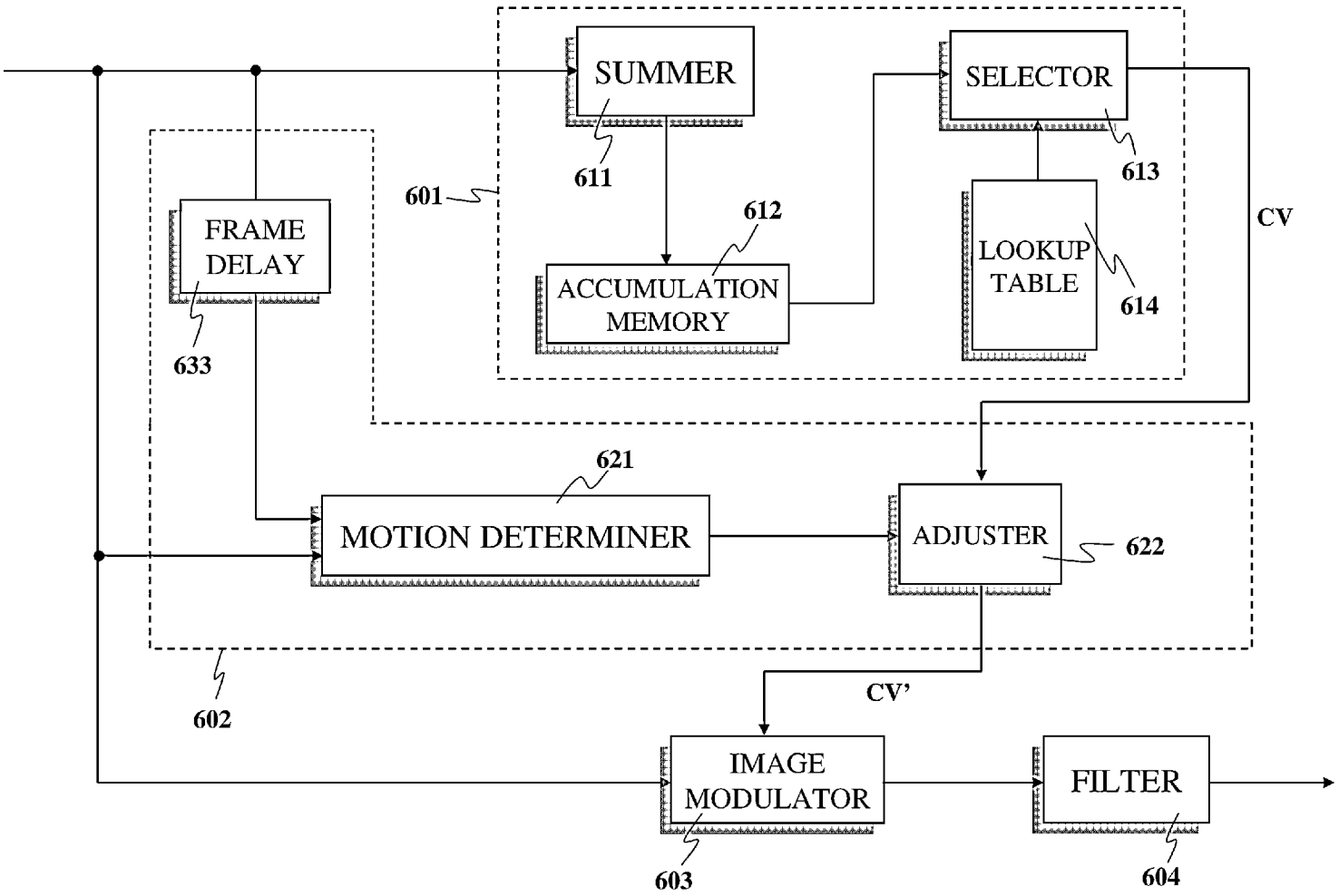
FIG. 6 is a block diagram illustrating a data adjuster according to a second embodiment of the present invention.

FIG. 6 is a block diagram illustrating a data adjuster DA according to a second embodiment of the present invention.

As shown in FIG. 6, the data adjuster DA according to the second embodiment of the present invention includes a compensation value generator 601, a compensation value adjuster 602, an image modulator 603, and a filter 604.

The compensation value generator 601 is similar to the compensation value generator 301 of the first embodiment and, as such, the description given in conjunction with FIG. 3 may be referred to for description of the compensation value generator 601.

The compensation value adjuster 602 determines a degree of motion of an image for each pixel based on image data from the system SYS. Based on the result of the determination, the compensation value adjuster 602 adjusts the compensation value CV output from the compensation value generator 601 for the pixel. That is, the compensation value adjuster 602 varies a compensation value CV for each pixel such that the difference between the original compensation value CV and the adjusted compensation value CV' is increased when the image for the pixel exhibits a higher degree of motion. For example, the compensation value adjuster 602 may vary an initially-set compensation value CV such that the adjusted value CV' is less than the original value.

Generally, as an image displayed on a pixel is more slowly varied, the viewer can more easily visually perceive the variation of the image. However, as an image displayed on a pixel is more rapidly varied, it is more difficult for the viewer to visually perceive the variation of the image. Based on such visual perception characteristics of humans, modulation of image data is carried out in the present invention. In detail, the LED display device according to the second embodiment of the present invention applies a smaller compensation value to a pixel displaying a more rapid image, which cannot be easily visually perceived and, as such, it is possible to reduce degradation of the pixel without degradation in picture quality, as compared to conventional cases.

The image modulator 603 is similar to the image modulator 303 of the first embodiment and, as such, the description given in conjunction with FIG. 3 may be referred to, for description of the image modulator 603.

The filter 604 is similar to the filter 304 of the first embodiment and, as such, the description given in conjunction with FIG. 3 may be referred to, for description of the filter 604.

Hereinafter, configurations of the compensation value generator 601 and compensation value adjuster 602 shown in FIG. 6 will be described in more detail.

As shown in FIG. 6, the compensation value generator 601 includes an accumulation memory 612, a summer 611, a selector 613, and a lookup table 614. These constituent elements are similar to the corresponding elements 312, 311, 313, 314 of the first embodiment and, as such, the description given in conjunction with FIG. 3 may be referred to for description of the constituent elements.

The compensation value adjuster 602 determines similarity of each pixel between successive frames to determine a degree of motion for the pixel in the current frame period.

For this determination, the compensation value adjuster 602 compares image data to be supplied to the pixel in question in the current frame period with image data supplied to the pixel in question in at least one of previous frame periods. Based on the result of the comparison, the compensation value adjuster 602 determines a degree of motion of the image data to be supplied to the pixel in question.

In one embodiment, the compensation value adjuster 602 receives, from the system SYS, image data to be supplied to the pixel in question in a p-th frame period (where p is a natural number greater than "1"). In response to the image data from the system SYS, the compensation value adjuster 602 outputs previous image data of a "p−1"-th frame period, which has been previously stored. Thereafter, the compensation value adjuster 602 calculates a difference between the image data to be supplied to the pixel in question in the p-th frame period and the image data supplied to the pixel in question in the "p−1"-th frame period, to derive a difference value. Subsequently, the compensation value adjuster 602 produces an absolute value of the difference value, and defines the absolute value as a motion value representing a degree of motion of the image data for the pixel in question. The definition may be expressed by the following Equation:

$$TV_{i,j}=|P_{i,j}(n)-P_{i,j}(n-1)|>k \quad \text{[Equation 2]}$$

In Equation 2, "$TV_{i,j}$" represents a motion value of a pixel arranged on an i-th row and a j-th column in the display (namely, a pixel in question).

When the motion value for the pixel in question is greater than a predetermined motion threshold value k, the compensation value adjuster 602 adjusts the compensation value of the pixel in question such that the difference between the original compensation value and the adjusted compensation value is still further increased in accordance with a still further increase in the difference between the motion value and the predetermined motion threshold value k. On the other hand, when the motion value for the pixel in question is equal to or less than the predetermined motion threshold value k, the compensation value adjuster 602 maintains the compensation value CV set for the pixel in question. That is, the compensation value adjuster 602 does not adjust the compensation value CV set for the pixel in question when the motion value for the pixel in question is equal to or less than the predetermined motion threshold value k.

Figure 7:
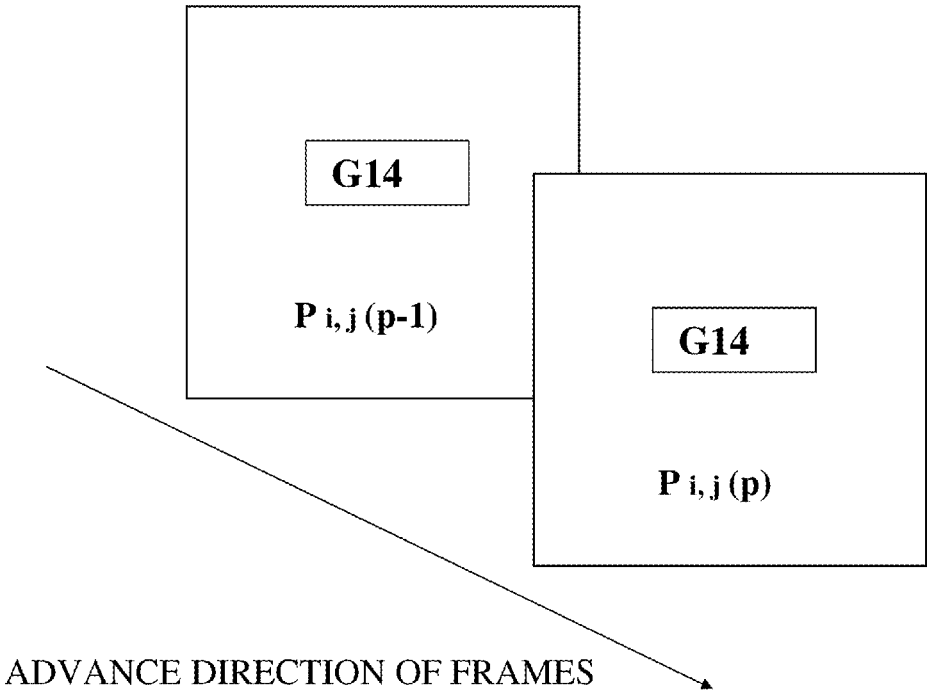
FIG. 7 illustrates a method for calculating a motion value for a pixel in question.

FIG. 7 illustrates a method for calculating a motion value for a pixel in question. FIG. 7 shows a motion variation occurring in a pixel in question between successive frame periods.

In order to derive a motion value for the 14-th green pixel G14 in the current frame period, as shown in FIG. 7, it is necessary to use the image data supplied to the 14-th green pixel G14 in a frame period immediately preceding the current frame period, namely, an immediately previous frame period.

When it is assumed that "(Pi, j(p))" represents the image data in question to be supplied to the 14-th green pixel G14 in the current frame period, the image data supplied to the 14-th green pixel G14 in the previous frame period may be represented by "(Pi, j(p−1))".

Using Equation 2, the compensation value adjuster 602 calculates a difference value between the current image data (Pi, j(p)) and the previous image data (Pi, j(p−1)). Thereafter, the compensation value adjuster 602 produces an absolute value of the derived difference value, and compares the absolute value with the predetermined motion threshold value k. When it is determined, based on the result of the comparison, that the motion value is greater than the predetermined motion threshold value k, the compensation value adjuster 602 adjusts the compensation value of the pixel in question such that the difference between the original compensation value and the adjusted compensation value is still further increased in accordance with a still further increase in the difference between the motion value and the predetermined motion threshold value k. On the other hand, when the motion value is equal to or less than the predetermined motion threshold value k, the compensation value adjuster 602 maintains the compensation value set for the pixel in question.

In this case, the compensation value adjuster 602 adjusts the compensation value CV of the pixel in question such that the difference between the original compensation value CV and the adjusted compensation value CV' is still further increased when the pixel in question exhibits a still higher motion value. For example, the compensation value adjuster 602 may perform adjustment of the compensation value CV, using a value less than the original compensation value CV. In this case, when the pixel in question exhibits a still higher motion value, the compensation value adjuster 602 adjusts the compensation value CV such that the adjusted compensation value CV' is still further less than the original compensation value CV.

Meanwhile, the compensation value adjuster 602 may vary the adjustment magnitude for the compensation value CV in accordance with the color of image data. For example, even when red image data to be supplied to a red pixel, green image data to be supplied to a green pixel, blue image data to be supplied to a blue pixel, and white image data to be supplied to a white pixel exhibit the same complexity value, the adjusted compensation values for the red pixel, green pixel, blue pixel, and white pixel may be set to different values, respectively.

The compensation value adjuster 602 may include a frame delay 633, a motion determiner 621 and an adjuster 622, as shown in FIG. 6.

The frame delay 633 stores image data of a p-th frame period in response to the image data supplied from the system SYS in the p-th frame period. Simultaneously, the frame delay 633 outputs previous image data of a "p−1"-th frame period, which has been previously stored.

The motion determiner 621 generates a motion value as to each pixel, based on image data from the system SYS and image data from the frame delay 633.

The adjuster 622 adjusts a compensation value CV supplied from the compensation value generator 601, based on the motion value from the motion determiner 621, thereby generating an adjusted compensation value CV'.

Third Embodiment

Figure 8:
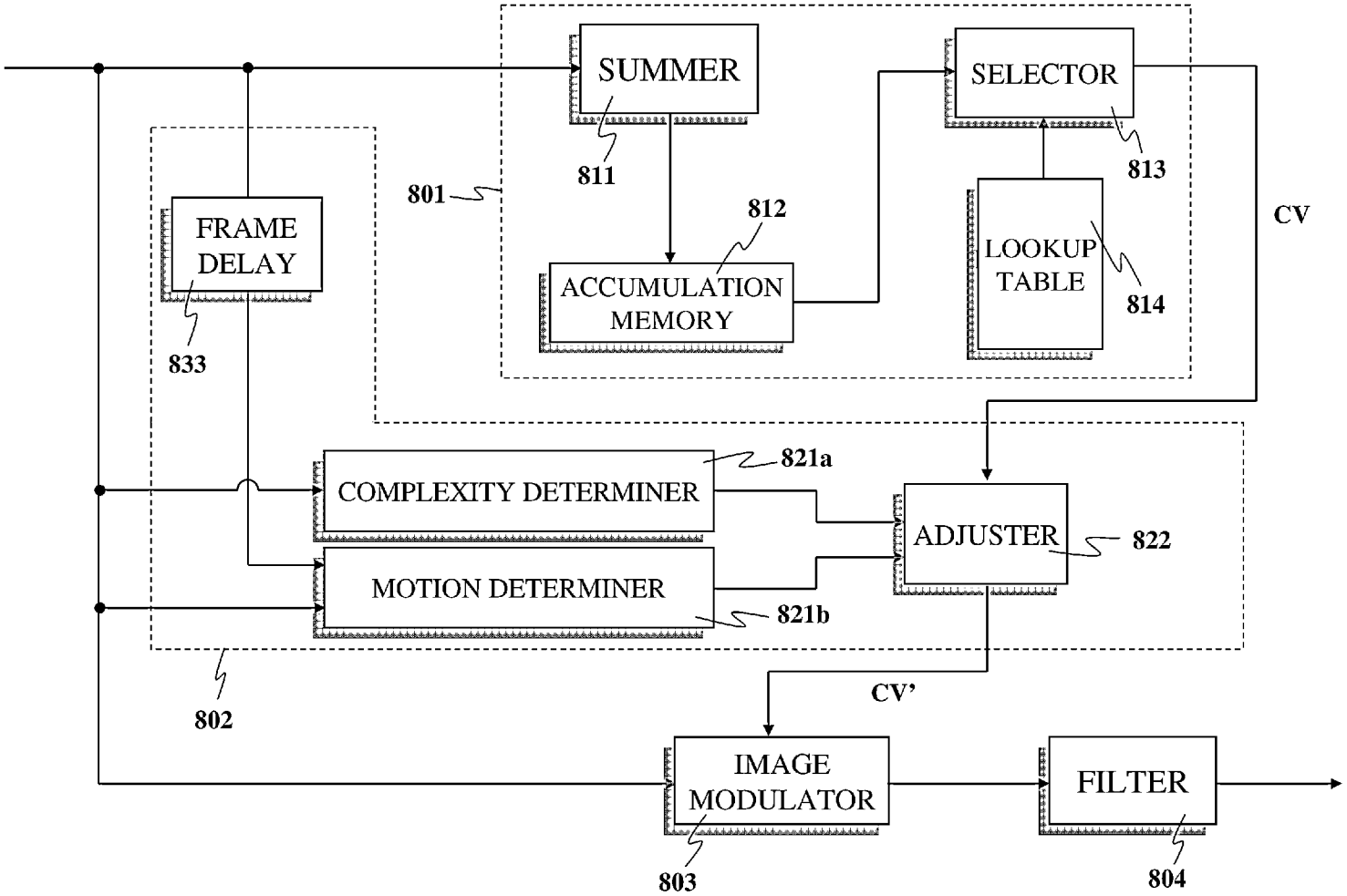
FIG. 8 is a block diagram illustrating a data adjuster according to a third embodiment of the present invention.

FIG. 8 is a block diagram illustrating a data adjuster DA according to a third embodiment of the present invention.

As shown in FIG. 8, the data adjuster DA according to the third embodiment of the present invention includes a compensation value generator 801, a compensation value adjuster 802, an image modulator 803, and a filter 804.

The compensation value generator 801, image modulator 803 and filter 804 are similar to the corresponding elements 301, 303, 304 of the first embodiment and, as such, the description given in conjunction with FIG. 3 may be referred to for description of the compensation value generator 801, image modulator 803 and filter 804.

The compensation value adjuster 802 determines a degree of complexity and a degree of motion in an image for each pixel, based on image data from the system SYS. Based on the result of the determination, the compensation value adjuster 802 adjusts the compensation value CV output from the compensation value generator 801 for the pixel. That is, the compensation value adjuster 802 varies a compensation value for each pixel such that the difference between the original compensation value CV and the adjusted compensation value CV is increased when the image for the pixel exhibits a higher degree of complexity and a higher degree of motion. For example, the compensation value adjuster 802 may vary an initially-set compensation value CV such that the adjusted value CV' is less than the original value.

The compensation value adjuster 802 may include a frame delay 833, a complexity determiner 821*a*, a motion determiner 821*b* and an adjuster 822, as shown in FIG. 8.

The frame delay 833, complexity determiner 821*a* and motion determiner 821*b* are similar to the corresponding elements 633, 321, 621 of the first embodiment or second embodiment and, as such, the description given in conjunction with FIGS. 3 and 6 may be referred to, for description of the frame delay 833, complexity determiner 821*a* and motion determiner 821*b*.

The adjuster 822 adjusts the compensation value CV of the pixel in question such that the difference between the original compensation value CV and the adjusted compensation value CV' is still further increased when the pixel in question exhibits a still further higher complexity value or a still higher motion value. In this case, when the motion value for the pixel in question is greater than the predetermined motion threshold value k, the adjuster 822 adjusts the compensation value CV of the pixel in question such that the difference between the original compensation value CV and the adjusted compensation value CV' is still further increased in accordance with a still further increase in the difference between the motion value and the predetermined motion threshold value k.

FIG. 9 is a table illustrating gain values stored in the adjuster 822 of FIG. 8.

The adjuster 822 of FIG. 8 contains a plurality of attenuation gain values set through combination of complexity values and motion values. In accordance with a still higher complexity value or a still higher motion value, the attenuation gain value, which corresponds to the complexity value or motion value, is still further increased. Here, each of the complexity value and motion value may be set to one of "1" to "10". An increased number of numeric values may be employed to set the complexity value and motion value.

Upon receiving a complexity value from the complexity determiner 821*a* and a motion value from the motion determiner 821*b*, the adjuster 822 sets an x-axis value, namely, a column value, based on the received complexity value, while setting a y-axis value, namely, a row value, based on the received motion value, to select an attenuation gain value at an intersection between a column represented by the column value and a row represented by the row value. Based on the selected attenuation gain value, the adjuster 822 adjusts the compensation value CV. A lower gain value represents a higher degree of complexity and a higher degree of motion, whereas a higher gain value represents a lower degree of complexity and a lower degree of motion. For a still higher attenuation gain value, the adjuster 822 adjusts the compensation value CV such that the adjusted compensation value CV' is still further less than the original compensation value CV.

Meanwhile, the filters 304, 604 and 804 may be dispensed with in respective embodiments. That is, modified image data from the image modulator 303, 603 or 803 may be directly transmitted to the timing controller TC.

Figure 10:
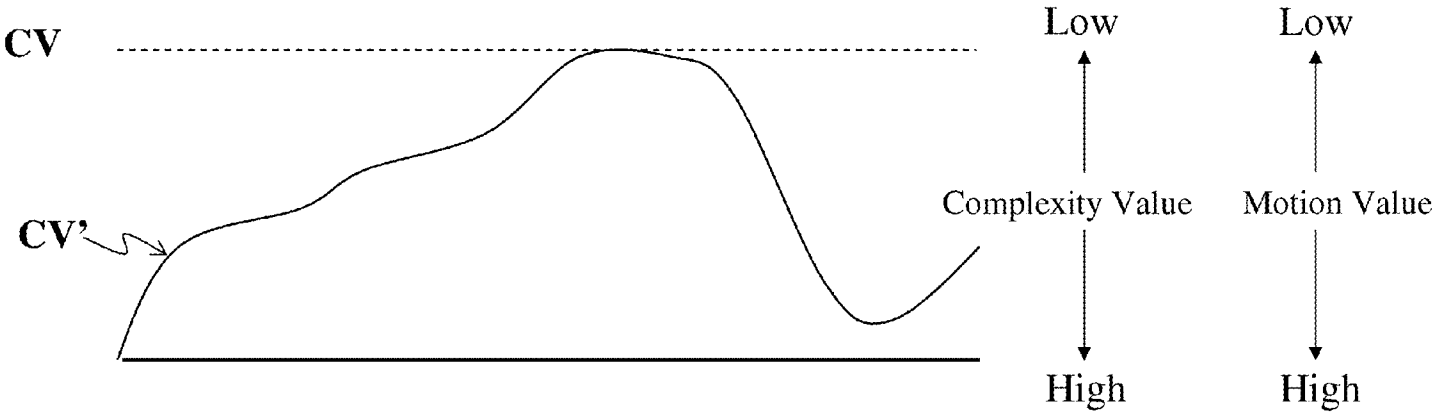
FIG. 10 is a graph depicting variation in a compensation value according to the present invention.

FIG. 10 is a graph depicting variation in a compensation value according to the present invention.

In FIG. 10, the dotted line represents a compensation value CV of a specific pixel (a pixel in question), and the curved line represents a value adjusted from the compensation value CV, namely, an adjusted compensation value CV'.

In FIG. 10, the x-axis may represent a position of the specific pixel or a frame period. Referring to FIG. 10, it can be seen that the complexity value or motion value is varied in accordance with variation in a pixel position or variation in a frame period, and the adjusted compensation value CV' may be varied in accordance with variation in a complexity value or motion value. In detail, it can be seen that the adjusted compensation value CV' is still further decreased for a still higher complexity value (a still higher motion value). Meanwhile, when the complexity value (or motion value) is "0", the adjusted compensation value CV' may be equal to the original compensation value CV.

Figure 11A:
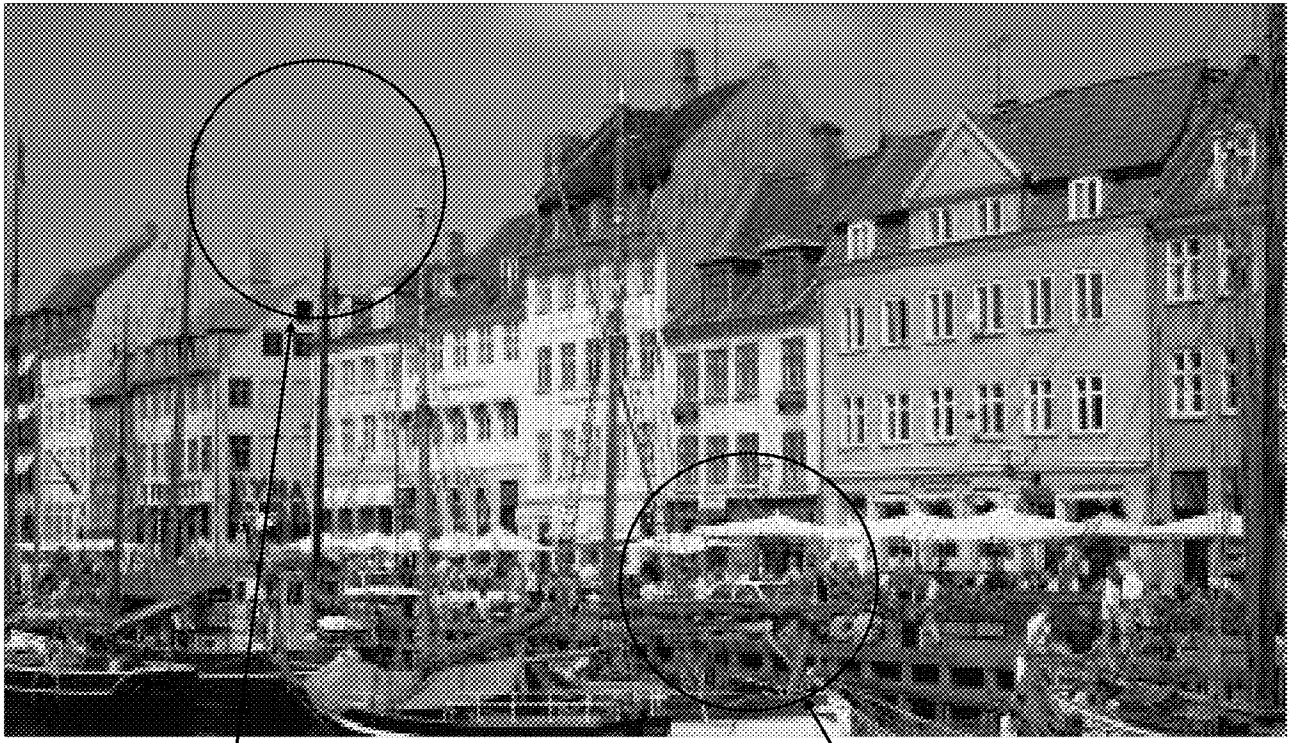
FIG. 11A illustrates high and low degrees of complexity of image data.

FIG. 11A illustrates high and low degrees of complexity of image data.

As shown in FIG. 11A, pixels arranged in a region A display images having gray scales, which are spatially substantially equal, and, as such, the degree of complexity as to each pixel in the region A is low. On the other hand, pixels arranged in a region B display images having different gray scales and, as such, the degree of complexity as to each pixel in the region B is high.

Figure 11B:
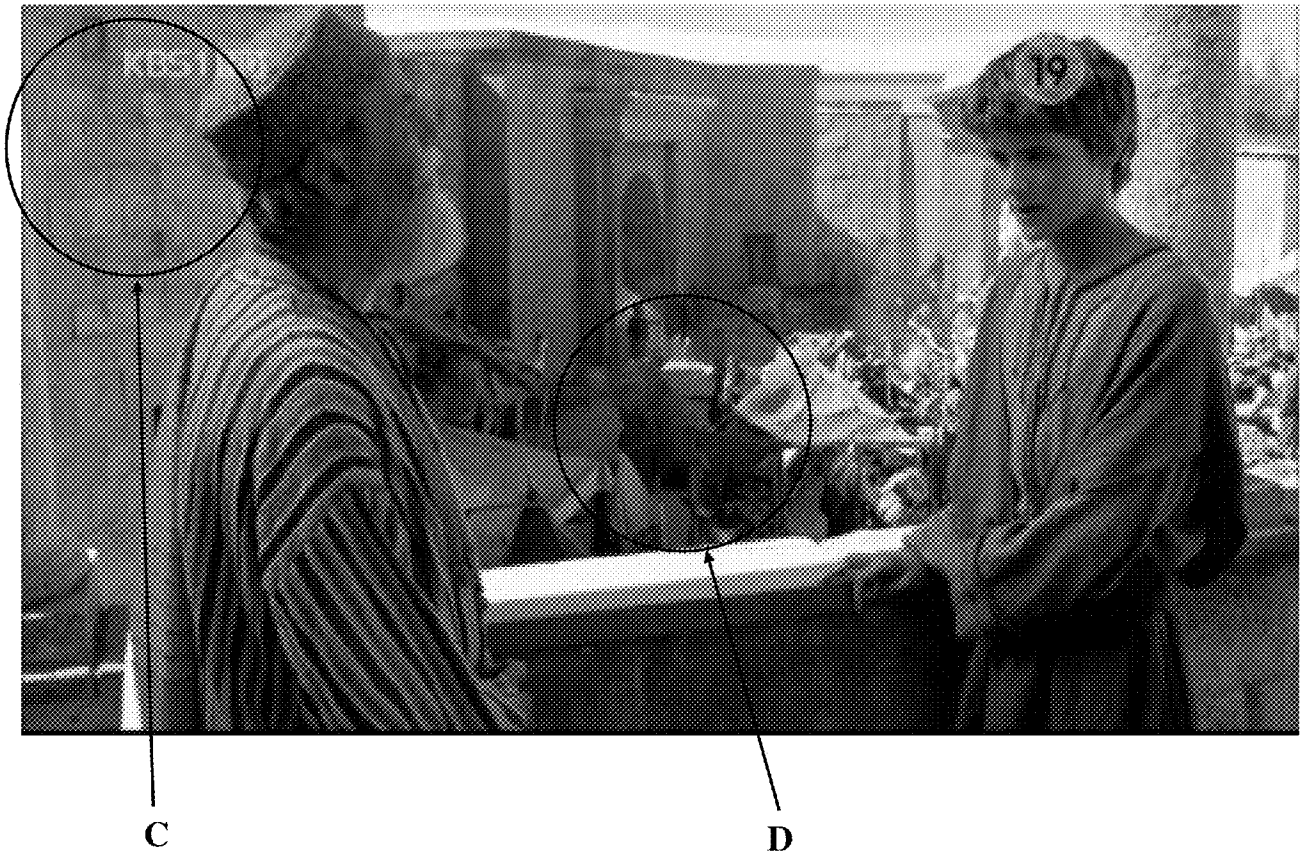
FIG. 11B illustrates high and low degrees of motion of image data.

FIG. 11B illustrates high and low degrees of motion of image data.

As shown in FIG. 11B, pixels arranged in a region C display images having gray scales, which are temporally substantially equal, and, as such, the degree of motion as to each pixel in the region C is low. On the other hand, pixels arranged in a region D display images having temporally different gray scales and, as such, the degree of motion as to each pixel in the region D is high.

FIG. 12 is a table explaining effects of the present invention.

In pictures of FIG. 12, which are displayed before degradation compensation, (namely, pictures ① and ②), specific regions (regions enclosed in a dotted box) represent regions where intentional brightness decrease has occurred (hereinafter, referred to as "degraded regions"). Each of the degraded regions may be formed when the gray scale (brightness) of image data applied to each pixel in the degraded region is set to be lower than a normal value by about 12%. Accordingly, the degraded regions in the pictures ① and ② of FIG. 12 are relatively dark, as compared to a normal state.

The degraded region of the picture ① exhibits a lower degree of complexity than that of the picture ②. That is, as described in the remark boxes of FIG. 12, it can be seen that the degree of complexity of the degraded region in the picture ① is 0.23, whereas the degree of complexity of the degraded region in the picture ② is 4.78.

Pictures ③ and ④ of FIG. 12 are pictures displayed after degradation compensation. In detail, the picture ③ shows results of degradation compensation carried out for the degraded region of the picture ①, whereas the picture ④ shows results of degradation compensation carried out for the degraded region of the picture ②. Degradation compensation is executed in the data adjuster according to the present invention.

The compensation level for the degraded region of the picture ① corresponds to a brightness increase of 12% because the degraded region of the picture ① exhibits a relatively low degree of complexity. That is, since the complexity value of the degraded region in the picture ① is low (0.23), the degraded region can be maintained in a normal brightness state, only when a compensation value exhibiting a compensation level corresponding to a brightness decreased due to degradation is applied to the image data of the degraded region. This case illustrates an example in which an original compensation value is used as is, without adjustment thereof.

On the other hand, the compensation level for the degraded region of the picture ② corresponds to a brightness increase of 9% because the degraded region of the picture ② exhibits a relatively high degree of complexity. That is, since the complexity value of the degraded region in the picture ② is high (4.78), the degraded region may be visually perceived as a normal region, even when a compensation value exhibiting a compensation level corresponding to a brightness lower than the brightness decreased due to degradation is applied to the image data of the degraded region. This case illustrates an example in which an adjusted compensation value lower than an original compensation value is used.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting diode display device comprising:

a system configured to output image data to be supplied to pixels, each pixel comprising a light emitting diode element;

a compensation value generator configured to determine a drive time of the light emitting diode element in each of the pixels based on the image data from the system, and further configured to generate a compensation value for the pixel based on the determined drive time of the light emitting diode element;

a compensation value adjuster configured to determine at least one of (i) a degree of complexity of the image data determined based on differences in grayscale across pixels in the image data to be supplied to the pixels and (ii) a degree of motion in an image for each of the pixels based on the image data from the system, and further configured to adjust the compensation value generated for the pixel by the compensation value generator based on a result of the determination, wherein a degree of motion for a pixel is computed as an absolute value of a difference between successive image data to be supplied to the pixel, and an adjustment to the compensation value for the pixel based on the computed degree of motion is in a same direction relative to an initially generated compensation value for the pixel regardless of a polarity of the difference, and wherein:

the compensation value adjuster performs a first adjustment to compensation values generated for a group of pixels of the display device based on the degree of complexity of first image data to be supplied to the group of pixels, and performs a second adjustment to the compensation values generated for the same group of pixels based on the degree of complexity of second image data to be supplied to the same group of pixels, the first and second adjustments to the compensation values being different when the first and second image data are different from each other; or the compensation value adjuster performs a first adjustment to compensation values computed for a first degree of motion in a first image and a second adjustment to compensation values computed for a second degree of motion in a second image, wherein the first adjustment results in a greater luminance increase than the second adjustment responsive to the first degree of motion being lower than the second degree of motion; and an image modulator configured to modulate the image data yet to be supplied to the pixels from the system based on the adjusted compensation value from the compensation value adjuster.

2. The light emitting diode display device according to claim 1, wherein the compensation value adjuster adjusts the compensation value of each of the pixels such that a difference between an original value of the compensation value and an adjusted value of the compensation value is increased when the image for the pixel has a higher degree of complexity.

3. The light emitting diode display device according to claim 2, wherein the compensation value adjuster adjusts the compensation value such that the adjusted compensation value is less than the original compensation value.

4. The light emitting diode display device according to claim 2, wherein the compensation value adjuster compares image data to be supplied to one of the pixels, which is a pixel in question, with n data pieces (where n is a natural number greater than "1") of peripheral image data to be supplied to a plurality of peripheral pixels arranged spatially adjacent to the pixel in question, and determines a degree of complexity of the image data to be supplied to the pixel in question based on a result of the comparison.

5. The light emitting diode display device according to claim 4, wherein the compensation value adjuster:

receives the image data from the system, calculates a difference between the image data piece in question and each of the n peripheral image data pieces to derive n difference values, produces respective absolute values of the n difference values, sums the n absolute values to derive a sum of the absolute difference values, divides the sum by "n" to derive an average value, multiplies the average value by "$100/2^m-1$" (where m is the number of bits of the image data piece in question or one of the peripheral image data pieces), and defines a final value derived by the multiplication as a complexity value representing a degree of complexity of the image data piece for the pixel in question; and wherein the compensation value adjuster adjusts the compensation value of the pixel in question such that a difference between an original value of the compensation value and an adjusted value of the compensation value is increased when the final value is higher.

6. The light emitting diode display device according to claim 5, wherein the compensation value adjuster comprises:

a complexity determiner configured to generate a complexity value for each of the pixels based on the image data from the system; and an adjuster configured to adjust the compensation value supplied for the pixel from the compensation value generator based on the complexity value from the complexity determiner.

7. The light emitting diode display device according to claim 1, wherein the compensation value adjuster adjusts the compensation value of each of the pixels such that a difference between an original value of the compensation value and an adjusted value of the compensation value is increased when the image for the pixel has a higher degree of motion.

8. The light emitting diode display device according to claim 7, wherein the compensation value adjuster adjusts the compensation value such that the adjusted compensation value is less than the original compensation value.

9. The light emitting diode display device according to claim 7, wherein the compensation value adjuster compares image data to be supplied in a current frame period to one of the pixels, which is a pixel in question, with image data supplied to the pixel in question in at least one of previous frame periods, and determines a degree of motion of the image data to be supplied to the pixel in question based on a result of the comparison.

10. The light emitting diode display device according to claim 9, wherein:

the compensation value adjuster receives, from the system, image data to be supplied to the pixel in question in a p-th frame period (where p is a natural number greater than "1"), and outputs previous image data of a "p−1"-th frame period, which has been previously stored, in response to the received image data;

the compensation value adjuster calculates a difference between the image data to be supplied to the pixel in question in the p-th frame period and the image data supplied to the pixel in question in the "p−1"-th frame period to derive a difference value, produces an absolute value of the difference value, and defines the absolute value as a motion value representing a degree of motion of the image data for the pixel in question;

when the motion value for the pixel in question is greater than a predetermined motion threshold value, the compensation value adjuster adjusts the compensation value of the pixel in question such that a difference between an original value of the compensation value and an adjusted value of the compensation value is increased in accordance with an increase in a difference between the motion value and the predetermined motion threshold value; and when the motion value for the pixel in question is equal to or less than the predetermined motion threshold value, the compensation value adjuster maintains the compensation value of the pixel in question without adjustment.

11. The light emitting diode display device according to claim 10, wherein the compensation value adjuster comprises:

a frame delay for storing the image data of the p-th frame period in response to the image data supplied from the system in the p-th frame period, and simultaneously outputting previous image data of the "p−1"-th frame period, which has been previously stored;

a motion determiner for generating a motion value for each of the pixels based on the image data from the system and the image data output from the frame delay; and an adjuster for adjusting a compensation value supplied for the pixel from the compensation value generator based on the motion value from the motion determiner.

12. The light emitting diode display device according to claim 1, wherein the compensation value adjuster adjusts the compensation value of each of the pixels such that a difference between an original value of the compensation value and an adjusted value of the compensation value is increased when the image for the pixel has a higher degree of complexity and a higher degree of motion.

13. The light emitting diode display device according to claim 12, wherein the compensation value adjuster adjusts the compensation value such that the adjusted compensation value is less than the original compensation value.

14. The light emitting diode display device according to claim 12, wherein:

the compensation value adjuster compares image data to be supplied to one of the pixels, which is a pixel in question, with n data pieces (where n is a natural number greater than "1") of peripheral image data to be supplied to a plurality of peripheral pixels arranged spatially adjacent to the pixel in question, thereby determining a degree of complexity of the image data to be supplied to the pixel in question; and the compensation value adjuster compares image data to be supplied in a current frame period to the pixel in question with image data supplied to the pixel in question in at least one of previous frame periods, thereby determining a degree of motion of the image data to be supplied to the pixel in question.

15. The light emitting diode display device according to claim 14, wherein:

the compensation value adjuster receives the image data from the system, calculates a difference between the image data piece in question and each of the n peripheral image data pieces to derive n difference values, produces respective absolute values of the n difference values, sums the n absolute values to derive a sum of the absolute difference values, divides the sum by "n" to derive an average value, multiplies the average value by "$100/2^m-1$" (where m is the number of bits of the image data piece in question or one of the peripheral image data pieces), and defines a final value derived by the multiplication as a complexity value representing a degree of complexity of the image data piece for the pixel in question;

the compensation value adjuster receives, from the system, image data to be supplied to the pixel in question in a p-th frame period (where p is a natural number greater than "1"), and outputs previous image data of a "p−1"-th frame period, which has been previously stored, in response to the received image data;

the compensation value adjuster calculates a difference between the image data to be supplied to the pixel in question in the p-th frame period and the image data supplied to the pixel in question in the "p−1"-th frame period to derive a difference value, produces an absolute value of the difference value, and defines the absolute value as a motion value representing a degree of motion of the image data for the pixel in question;

the compensation value adjuster adjusts the compensation value of the pixel in question such that a difference between an original value of the compensation value and an adjusted value of the compensation value is still further increased when the complexity value and the motion value are still higher; and when the motion value for the pixel in question is greater than a predetermined motion threshold value, the compensation value adjuster adjusts the compensation value of the pixel in question such that the difference between the original compensation value and the adjusted compensation value is still further increased in accordance with a still further increase in the complexity value and the motion value.

16. The light emitting diode display device according to claim 15, wherein the compensation value adjuster comprises:

a complexity determiner configured to generate a complexity value as to each of the pixels based on the image data from the system;

a frame delay configured to store the image data of the p-th frame period in response to the image data supplied from the system in the p-th frame period, and simultaneously outputting previous image data of the "p−1"-th frame period, which has been previously stored;

a motion determiner configured to generate a motion value for each of the pixels based on the image data from the system and the image data output from the frame delay; and an adjuster for adjusting the compensation value supplied for the pixel from the compensation value generator based on the complexity value from the complexity determiner and the motion value from the motion determiner.

17. The light emitting diode display device according to claim 1, wherein the compensation value generator comprises:

an accumulation memory configured to store image data of a plurality of previous frames in a state in which corresponding data pieces of the image data are accumulatively summed;

a summer configured to receive image data of a current frame from the system, sum data pieces of the image data of the current frame with data pieces of the accumulated image data stored for one frame in the accumulation memory in such a manner that corresponding ones of the data pieces are summed to newly generate accumulated image data of one frame, and update the accumulated one-frame image data stored in the accumulation memory with the newly-generated one-frame accumulated image data;

a lookup table containing a plurality of compensation values predetermined in accordance with values of accumulated image data; and a selector configured to select, from the lookup table, compensation values corresponding to respective data pieces of one-frame accumulated image data stored in the accumulation memory.

18. The light emitting diode display device according to claim 1, further comprising:

a filter for filtering modulated image data output from the image modulator to secure spatial and temporal uniformity of the modulated image data.

19. A method for driving a light emitting diode display device, comprising the steps of:

(A) outputting image data to be supplied to pixels each including a light emitting diode element;

(B) determining a drive time of the light emitting diode element in each of the pixels, based on the image data from the step (A), and generating a compensation value for the pixel based on the determined drive time of the light emitting diode element;

(C) determining at least one of (i) a degree of complexity of the image data determined based on differences in grayscale across pixels in the image data to be supplied to the pixels and (ii) a degree of motion in an image for each of the pixels based on the image data from the step (A), and adjusting the compensation value generated, for the pixel, from the step (B), based on a result of the determination, wherein determining a degree of motion for a pixel comprises computing as an absolute value of a difference between successive image data to be supplied to the pixel, wherein adjusting the compensation value for the pixel based on the computed degree of motion comprises adjusting the compensation value for the pixel in a same direction relative to an initially generated compensation value for the pixel regardless of a polarity of the difference, and wherein adjusting the compensation value comprises:

performing a first adjustment to compensation values generated for a group of pixels of the display device based on the degree of complexity of first image data to be supplied to the group of pixels, and performing a second adjustment to the compensation values generated for the same group of pixels based on the degree of complexity of second image data to be supplied to the same group of pixels, the first and second adjustments to the compensation values being different when the first and second image data are different from each other; or performing a first adjustment to compensation values computed for a first degree of motion in a first image and a second adjustment to compensation values computed for a second degree of motion in a second image, wherein the first adjustment results in a greater luminance increase than the second adjustment responsive to the first degree of motion being lower than the second degree of motion; and (D) modulating the image data yet to be supplied to the pixels from the step (A), based on the adjusted compensation value from the step (C).

20. The method according to claim 19, wherein the step (C) comprises adjusting the compensation value for each of the pixels such that a difference between an original value of the compensation value and an adjusted value of the compensation value is increased when the image for the pixel has a higher degree of complexity.

21. The method according to claim 20, wherein the step (C) comprises adjusting the compensation value such that the adjusted compensation value is less than the original compensation value.

22. The method according to claim 20, wherein the step (C) comprises:

comparing image data to be supplied to one of the pixels, which is a pixel in question, with n data pieces (where n is a natural number greater than "1") of peripheral image data to be supplied to a plurality of peripheral pixels arranged spatially adjacent to the pixel in question, and determining a degree of complexity of the image data to be supplied to the pixel in question, based on a result of the comparison.

23. The method according to claim 22, wherein:

the step (C) comprises receiving the image data from the step (A), calculating a difference between the image data piece in question and each of the n peripheral image data pieces to derive n difference values, producing respective absolute values of the n difference values, summing the n absolute values to derive a sum of the absolute difference values, dividing the sum by "n" to derive an average value, multiplying the average value by "$100/2^m-1$" (where m is the number of bits of the image data piece in question or one of the peripheral image data pieces), and defining a final value derived by the multiplication as a complexity value representing a degree of complexity of the image data piece for the pixel in question; and the step (C) further comprises adjusting the compensation value of the pixel in question such that a difference between an original value of the compensation value and an adjusted value of the compensation value is still further increased when the final value is still higher.

24. The method according to claim 19, wherein the step (C) comprises adjusting the compensation value of each of the pixels such that a difference between an original value of the compensation value and an adjusted value of the compensation value is still further increased when the image for the pixel has a higher degree of motion.

25. The method according to claim 24, wherein the step (C) comprises adjusting the compensation value such that the adjusted compensation value is less than the original compensation value.

26. The method according to claim 24, wherein the step (C) comprises:

comparing image data to be supplied in a current frame period to one of the pixels, which is a pixel in question, with image data supplied to the pixel in question in at least one of previous frame periods, and determining a degree of motion of the image data to be supplied to the pixel in question, based on a result of the comparison.

27. The method according to claim 26, wherein the step (C) comprises receiving, from the step (A), image data to be supplied to the pixel in question in a p-th frame period (where p is a natural number greater than "1"), and outputting previous image data of a "p−1"-th frame period, which has been previously stored, in response to the received image data;

the step (C) comprises calculating a difference between the image data to be supplied to the pixel in question in the p-th frame period and the image data supplied to the pixel in question in the "p−1"-th frame period, to derive a difference value, producing an absolute value of the difference value, and defining the absolute value as a motion value representing a degree of motion of the image data for the pixel in question;

when the motion value for the pixel in question is greater than a predetermined motion threshold value, the step (C) comprises adjusting the compensation value of the pixel in question such that a difference between an original value of the compensation value and an adjusted value of the compensation value is increased in accordance with a further increase in a difference between the motion value and the predetermined motion threshold value; and when the motion value for the pixel in question is equal to or less than the predetermined motion threshold value, the step (C) comprises maintaining the compensation value of the pixel in question without adjustment.

28. The method according to claim 19, wherein the step (C) comprises adjusting the compensation value of each of the pixels such that a difference between an original value of the compensation value and an adjusted value of the compensation value is increased when the image for the pixel has a higher degree of complexity and a higher degree of motion.

29. The method according to claim 28, wherein the step (C) comprises adjusting the compensation value such that the adjusted compensation value is less than the original compensation value.

30. The method according to claim 28, wherein:

the step (C) comprises comparing image data to be supplied to one of the pixels, which is a pixel in question, with n data pieces (where n is a natural number greater than "1") of peripheral image data to be supplied to a plurality of peripheral pixels arranged spatially adjacent to the pixel in question, thereby determining a degree of complexity of the image data to be supplied to the pixel in question; and the step (C) comprises comparing image data to be supplied in a current frame period to the pixel in question with image data supplied to the pixel in question in at least one of previous frame periods, thereby determining a degree of motion of the image data to be supplied to the pixel in question.

31. The method according to claim 30, wherein:

the step (C) comprises receiving the image data from the step (A), calculating a difference between the image data piece in question and each of the n peripheral image data pieces to derive n difference values, producing respective absolute values of the n difference values, summing the n absolute values to derive a sum of the absolute difference values, dividing the sum by "n" to derive an average value, multiplying the average value by "$100/2^m-1$" (where m is the number of bits of the image data piece in question or one of the peripheral image data pieces), and defining a final value derived by the multiplication as a complexity value representing a degree of complexity of the image data piece for the pixel in question;

the step (C) comprises receiving, from the step (A), image data to be supplied to the pixel in question in a p-th frame period (where p is a natural number greater than "1"), and outputting previous image data of a "p−1"-th frame period, which has been previously stored, in response to the received image data;

the step (C) comprises calculating a difference between the image data to be supplied to the pixel in question in the p-th frame period and the image data supplied to the pixel in question in the "p−1"-th frame period to derive a difference value, producing an absolute value of the difference value, and defining the absolute value as a motion value representing a degree of motion of the image data for the pixel in question;

the step (C) comprises adjusting the compensation value of the pixel in question such that a difference between an original value of the compensation value and an adjusted value of the compensation value is increased when the complexity value and the motion value are higher; and when the motion value for the pixel in question is greater than a predetermined motion threshold value, the step (C) comprises adjusting the compensation value of the pixel in question such that the difference between the original compensation value and the adjusted compensation value is increased in accordance with an increase in the complexity value and the motion value.

32. The method according to claim 19, further comprising:

(E) filtering modulated image data output from the step (D), to secure spatial and temporal uniformity of the modulated image data.

* * * * *